US008850625B2

(12) United States Patent
Stiles

(10) Patent No.: US 8,850,625 B2
(45) Date of Patent: Oct. 7, 2014

(54) HEAD AND NECK SUPPORT DEVICE

(75) Inventor: Mark A. Stiles, Atlanta, GA (US)

(73) Assignee: Simpson Performance Products, Inc., New Braunfels, TX (US)

( * ) Notice: Subject to any disclaimer, the term of this patent is extended or adjusted under 35 U.S.C. 154(b) by 758 days.

(21) Appl. No.: 12/329,388

(22) Filed: Dec. 5, 2008

(65) Prior Publication Data

US 2009/0144886 A1 Jun. 11, 2009

Related U.S. Application Data

(60) Provisional application No. 60/992,609, filed on Dec. 5, 2007.

(51) Int. Cl.
*A42B 7/00* (2006.01)
*A41D 13/05* (2006.01)
*A42B 3/04* (2006.01)

(52) U.S. Cl.
CPC ..... *A42B 3/0473* (2013.01); *A41D 13/0512* (2013.01)
USPC ..... 2/421

(58) Field of Classification Search
CPC ..... A41D 13/0512; A42B 3/0473
USPC ..... 2/421, 422, 411, 468, 425; 280/290, 280/748, 751, 753, 801.1; 297/393, 391, 297/464, 473
See application file for complete search history.

(56) References Cited

U.S. PATENT DOCUMENTS 3,278,230 A * 10/1966 Boyce et al. ..... 297/465
4,638,510 A 1/1987 Hubbard
4,909,459 A 3/1990 Patterson
5,267,708 A 12/1993 Monson et al.
6,009,566 A * 1/2000 Hubbard ..... 2/468
6,751,809 B1 6/2004 Cooper et al.
6,810,535 B1 11/2004 Moloney
6,857,136 B1 2/2005 Bradley
6,931,669 B2 * 8/2005 Ashline ..... 2/422
6,978,523 B2 * 12/2005 Downing et al. ..... 24/628
7,017,194 B2 * 3/2006 Schroth ..... 2/410
7,120,982 B2 * 10/2006 Downing et al. ..... 29/401.1
D597,212 S * 7/2009 Stiles ..... D24/191
7,823,925 B2 * 11/2010 Sargent ..... 280/808

(Continued)

FOREIGN PATENT DOCUMENTS

JP 2006257614 9/2006
SI 9600306 A 10/1996
WO WO2007-050024 5/2007
WO WO 2008050307 5/2008

OTHER PUBLICATIONS

Ourproducts Moto R.

*Primary Examiner* — Khoa Huynh
*Assistant Examiner* — Anna Kinsaul
(74) *Attorney, Agent, or Firm* — Everman Law Firm, PA; Gregory R. Everman

(57) ABSTRACT

A head and neck support device for an occupant of a vehicle with a shoulder harness over the shoulders of the occupant and a helmet on a head of the occupant. The head and neck support device having a yoke, a tether, and at least one sleeve member, which has a cavity defined therethrough. The tether is configured to slide through the sleeve member cavity for a defined distance, which allows the occupant a greater range of side-to-side rotary head mobility.

26 Claims, 10 Drawing Sheets

(56) References Cited

U.S. PATENT DOCUMENTS

| | | | | |
|---|---|---|---|---|
| 2001/0002087 | A1* | 5/2001 | Townsend | 280/801.1 |
| 2004/0216206 | A1 | 11/2004 | Schroth | |
| 2005/0015858 | A1* | 1/2005 | Ashline | 2/421 |
| 2005/0204457 | A1* | 9/2005 | Stiles et al. | 2/425 |
| 2005/0206151 | A1* | 9/2005 | Ashline | 280/801.1 |
| 2007/0010771 | A1 | 1/2007 | Leatt | |
| 2007/0067896 | A1 | 3/2007 | Sargent | |
| 2007/0156072 | A1 | 7/2007 | Leatt | |

* cited by examiner

HEAD AND NECK SUPPORT DEVICE

This application claims priority to and the benefit of U.S. Provisional Application No. 60/992,609, filed on Dec. 5, 2007, which is incorporated in its entirety in this document by reference.

FIELD OF THE INVENTION

This invention relates generally to the field of head and neck support devices for use by occupants of cars, boats, aircraft, and the like. In particular, the present invention relates to an improved tethering system for a head and neck support device which acts to transfer force away from the neck of the occupant through the device to the shoulder harness of the vehicle.

BACKGROUND OF THE INVENTION

The driver and other occupants of high performance cars, planes, boats and other vehicles (collectively, "vehicles") typically wear equipment designed to reduce physical harm during use of the vehicle but especially to reduce physical harm during sudden deceleration, torque or impact of the vehicle. Standard pieces of such equipment include a helmet to reduce head injury and a shoulder harness attached to the vehicle for restraining torso movement relative to the seat and vehicle.

It was long ago realized that the neck undergoes various motions and loads during deceleration. In response, various devices have been developed in an attempt to reduce the amount of motions and loads experienced by the neck during deceleration. Additionally, devices have been developed to transmit loads from the helmeted head to the torso in an attempt to reduce neck muscle fatigue and extreme head motions. While these devices may reduce neck muscle fatigue and extreme head motions, they may also lead to other problems.

Generally, present head and neck devices that have proven to be variously effective in reducing the forces on an occupant's neck by restricting the extent of motion of the head with respect to the torso rely on a restrictive force being carried partially or fully to the torso. For example, U.S. Pat. Nos. 4,638,510 and 6,009,566 to Hubbard describe a head and neck support device with two tethers that are attached between the respective sides of the device user's helmet and a collar of the head and neck support device. The head and neck support device has a yoke integral with the collar that is configured to fit around the back of the user's shoulders, adjacent the neck, and on the front of the user's chest. The yoke defines a forward facing opening so that the user can put on the head and neck support device by placing their head and neck through the opening. In a further aspect, the upper surface of the yoke has a frictional material placed on it so that the vehicle seat belts can hold the yoke in place. This inhibits forward motion of the device and assists in overcoming the forward forces of the tethers pulling at the top of the device by the head/helmet and by the chest and shoulders dragging on the underside of the yoke.

The configuration of the two tethers of the device disclosed in the '510 and '566 patents allows the user a limited range of side-to-side rotary head motion. However, the user may desire an even greater range of rotary head motion in some instances. Thus, what is needed is a head and neck support device that effectively reduces the potential and actual forces acting on the user's neck, while allowing the user a greater range of rotary head motion.

SUMMARY OF THE INVENTION

According to various embodiments, the present invention is a head and neck support device for use in high performance vehicles. In one aspect, the device comprises a yoke configured to be worn by an occupant of a vehicle that has a front portion and a rear portion, a tether having a first end and a second end, and at least one sleeve member. The yoke may include an element resembling a collar mounted to, or integral with, the yoke. In one aspect, each sleeve member defines a cavity through which the tether can be slideably received. The at least one sleeve member can further define a first distance extending between a proximal end and a distal end of the at least one sleeve member. In this aspect, the tether can define a second distance between the first and second ends of the tether that is greater than the first distance.

In one aspect, the front portion of the yoke is configured to extend down from the shoulders of the occupant along a portion of the torso of the occupant. The rear portion of the yoke is configured to extend around and behind a portion of the neck and shoulders of the occupant. In another aspect, a portion of the front portion and/or the rear portion of the yoke can be provided with load bearing surfaces. In this aspect, the shoulder belts of the shoulder harness of the vehicle are configured to extend over a portion of the front and rear portions of the yoke on at least a portion of the load bearing surfaces when the device is mounted on a user. In this aspect, at least a portion of the device can be positioned between the shoulder belts and the occupant.

In a further aspect, the at least one sleeve member can be fixedly attached to the yoke. In another aspect, the at least one sleeve member comprises a plurality of sleeve members that are fixedly attached to the yoke. Optionally, the at least one sleeve member can be integrally formed therein a portion of the yoke. In one embodiment, in which the at least one sleeve member comprises a single sleeve member, the cavity defined therein the sleeve member extends the first distance between the distal and proximal ends of the single sleeve member. In an alternative exemplary embodiment, in which the at least one sleeve member comprises a first sleeve member and an opposed second sleeve member, the respective first and second sleeve members are spaced apart from each other such that the first distance extends from a distal end of the first sleeve member to the proximal end of the second sleeve member. As illustrated in the figures, the first distance is defined generally in a cavity plane that bisects the cavity in the at least one sleeve member. In is contemplated that the tether would slide generally in the cavity plane within the first distance of the at least one sleeve member.

In use, the tether can be inserted into the at least one sleeve member. The first end of the tether can then be attached to a first side of the user's helmet and the second end of the tether can then be attached to the second, opposite side of the helmet. The sliding tether arrangement of the present invention allows the user a greater range of rotary head motion around an axis that extends generally co-axial through the vertebra of the neck of the user.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

The present invention may be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

As used in the specification and the appended claims, the singular forms "a," "an" and "the" include plural referents unless the context clearly dictates otherwise. Thus, for example, reference to a "sleeve member" can include two or more such sleeve members unless the context indicates otherwise.

Ranges may be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Reference will now be made in detail to the present preferred embodiment(s) of the invention, examples of which are illustrated in the accompanying drawings. Wherever possible, the same reference numbers are used throughout the drawings to refer to the same or like parts.

Figure 1:
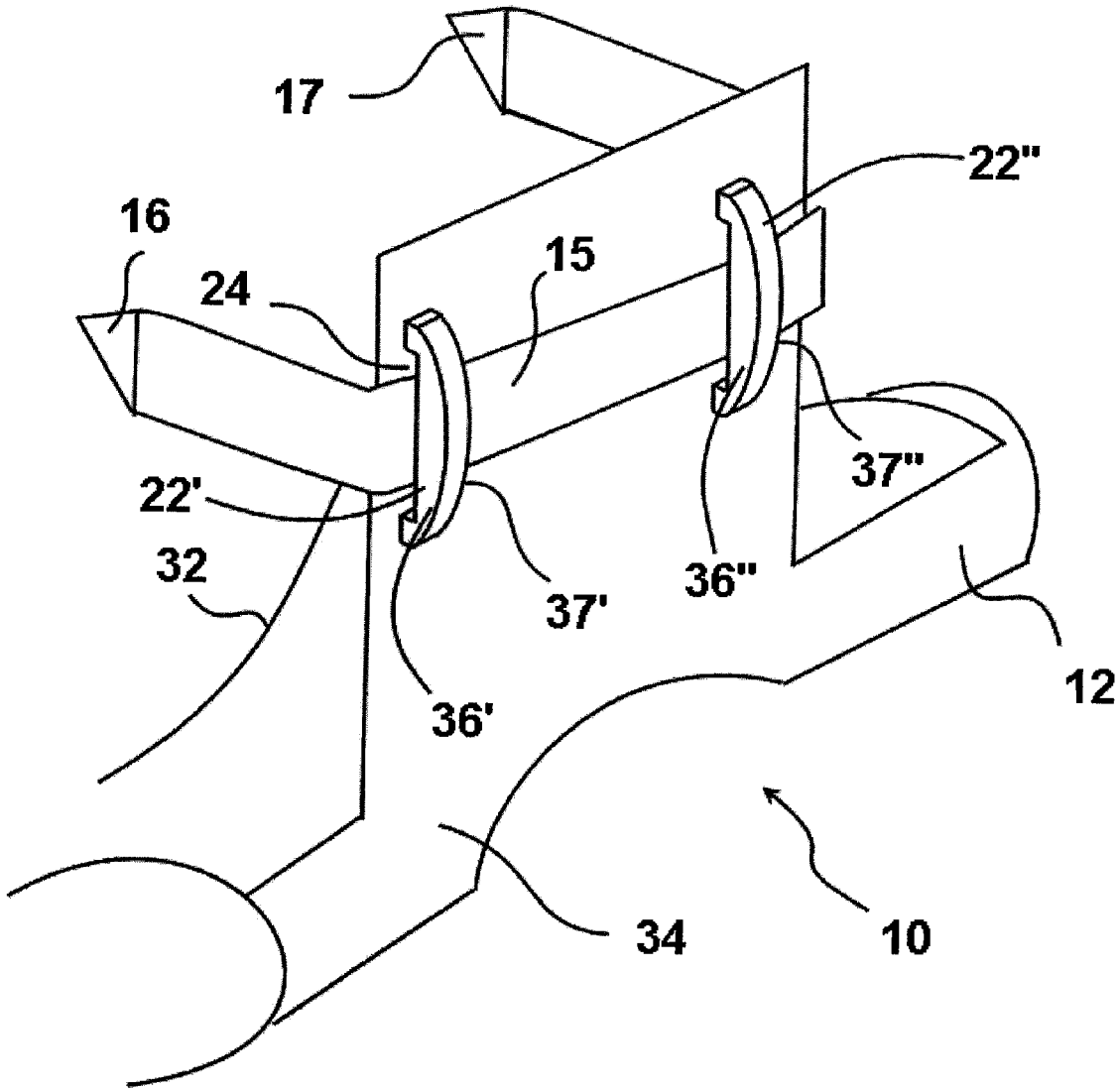
FIG. 1 is rear perspective view of one embodiment of the head and neck support device having plurality of sleeve members attached to a rear portion of the yoke.

A head and neck support device is provided, according to various aspects of the present invention. In one aspect, as shown in FIG. 1, a head and neck support device 10 comprises a yoke 12 and a tether 15. In one exemplary embodiment, the head and neck support device can comprise a yoke having a front portion 32 and a rear portion 34, a tether having a first end 16 and a second end 17, and at least one sleeve member 22. In this aspect, each sleeve member has a distal end 36 and a proximal end 37 and defines a cavity 24 that extends therebetween the distal and proximal ends. The at least one sleeve member can further define a first distance extending between a proximal end and a distal end of the at least one sleeve member. In a further aspect, the first distance can extend from the distal end of an outermost portion of at least one sleeve member to the proximal end of an opposed outermost portion of at least one sleeve member.

Figure 2:
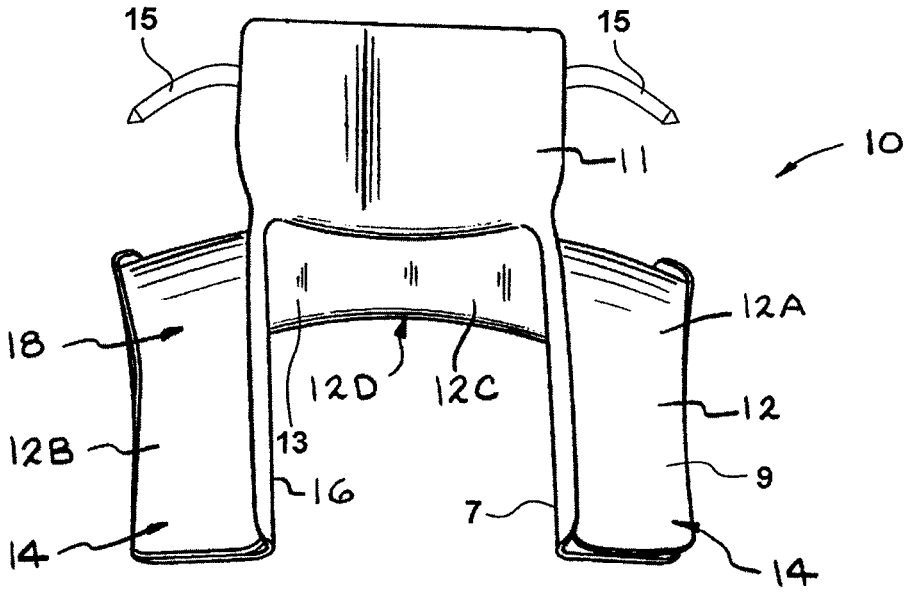
FIG. 2 is a front view of the head and neck support device of FIG. 1.
Figure 3:
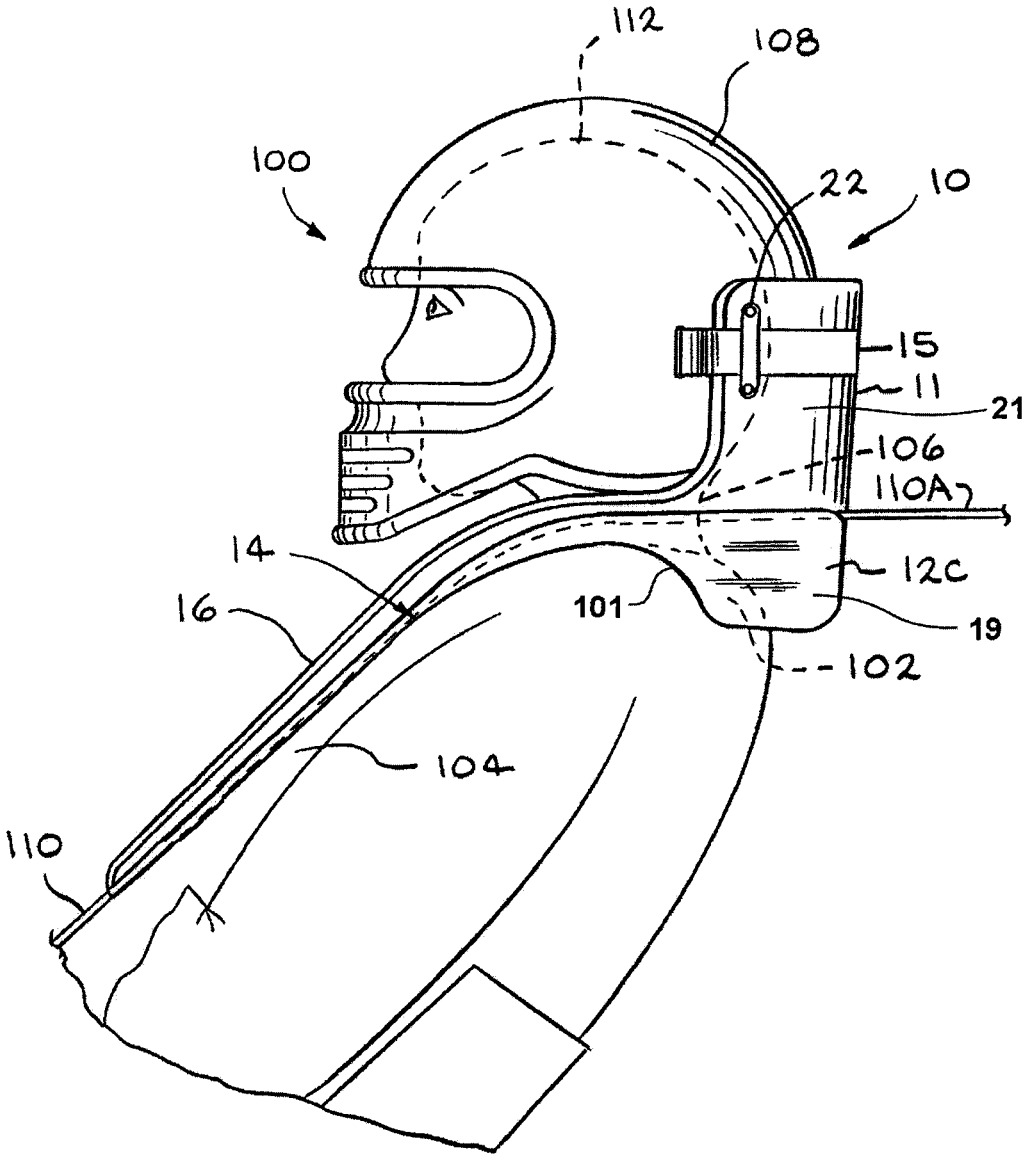
FIG. 3 is a side view of the head and neck support device of FIG. 1 mounted on an occupant.

Referring to FIG. 2, in one exemplary aspect, the yoke 12 can be generally U-shaped and has a pair of spaced opposing legs 12A and 12B that extend outwardly and downwardly from an intermediate connecting portion 12C. In one aspect, at least a portion of a bottom surface 101 of the yoke is configured to conform to the shoulders 102 and a front portion of the torso 104 of the occupant 100, as illustrated in FIG. 3. In another aspect, an inner surface 13 of the connecting portion of the yoke can define a notch 12D between the pair of spaced opposing legs 12A, 12B that is configured to accommodate a portion of the occupant's neck 106. It is further contemplated that a portion of the connecting portion of the yoke can be configured to have a thickness such that a bottom portion 19 of the connecting portion 12C extends down below a plane bisecting the top of the shoulders along the back of the occupant while a top portion 21 of the connecting portion is spaced above the plane bisecting the top of the occupant's shoulders.

Figure 11:
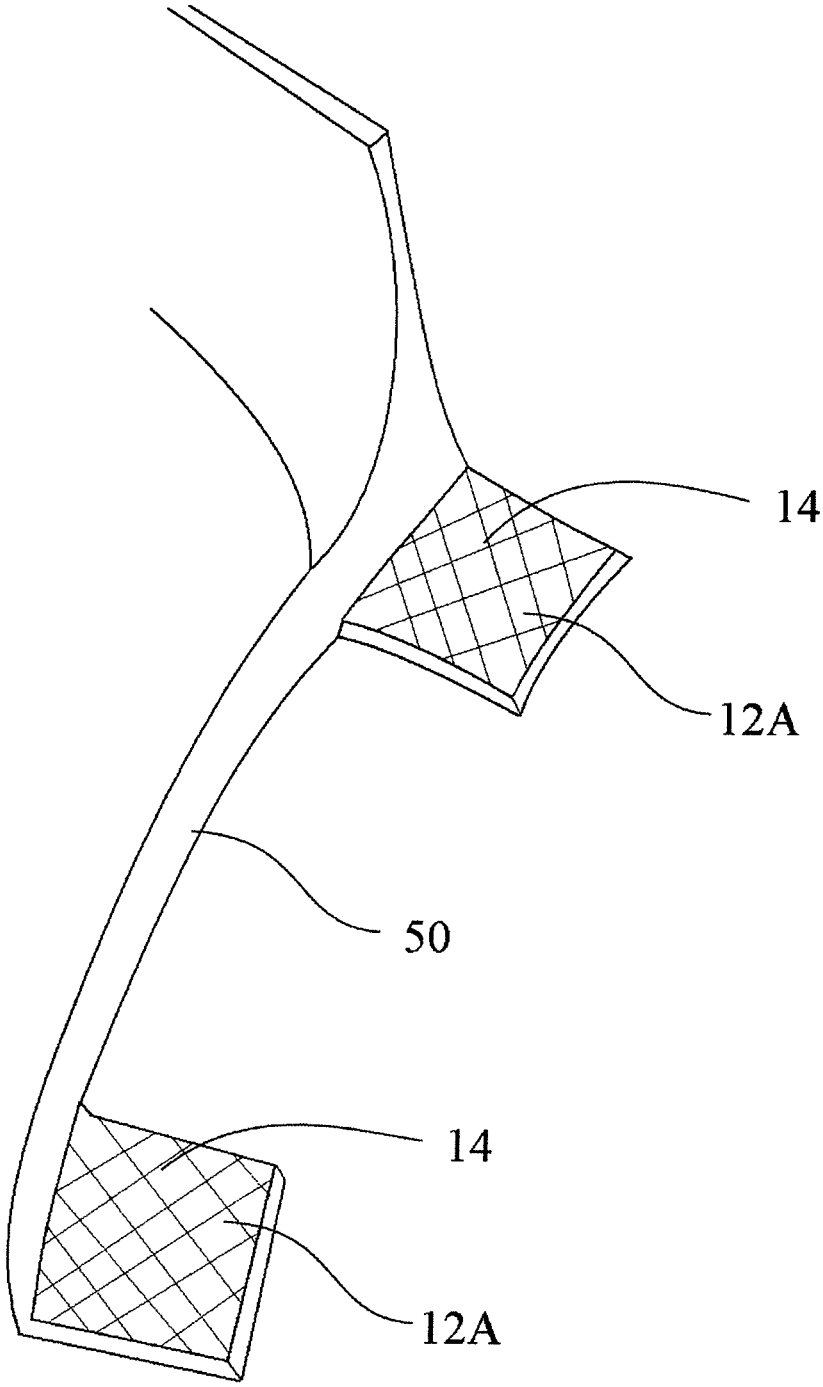
FIG. 11 is partial front perspective view of one embodiment of the head and neck support device having a plurality of yoke and/or load bearing portions.

In another exemplary aspect, at least a portion of an upper surface 9 of the yoke 12 can be provided with load bearing surfaces 14. In one aspect, and as shown in FIG. 2, the load bearing surfaces can be channels that are defined in the upper surface of the yoke. In one aspect, the load bearing surfaces can follow the shape of the upper surface of the yoke along the pair of legs and at the top portion of the connecting portion 12C. In one aspect, the thickness of the connecting portion of the yoke 12 can enable the load bearing surfaces adjacent the connecting portion of the yoke to be positioned behind and essentially at a vertical level with the shoulders 102 of the occupant, as can be seen in FIG. 3. In a further aspect, an inner edge 7 of the load bearing surfaces 14 can be preferably provided with a raised lip 16 that is configured to prevent the shoulder belts 110A of the shoulder harness 110 from slipping off the load bearing surfaces and inwardly toward the neck 106 of the occupant. In a further aspect, the width of the load bearing surfaces is preferably greater than the width of the shoulder belts of the shoulder harness. In another aspect, it is contemplated that at least a portion of the load bearing surfaces can be provided with a friction material, coating, and the like 18 that is configured to resist the shoulder belts from slipping on the load bearing surfaces 14 and provides for better transference of force from the load bearing surfaces to the shoulder harness 110. In one exemplary aspect, at least portions of the load bearing surfaces can be substantially flat in cross-section. Additionally, and as shown in FIG. 11, it is contemplated that portions of the yoke 12 and/or the load bearing surfaces can be integrally formed, or alternatively, that portions of the yoke and/or the load bearing surfaces 14 can be a plurality of discontinuous sections that are interconnected by, for example and without limitation, a plurality of rigid connecting members 50.

In one embodiment, illustrated in FIGS. 2 and 3, the yoke can further comprise a collar 11. In one aspect, the collar 11 can extend upwardly from the connecting portion 12C of the yoke 12 between the pair of spaced opposing legs 12A and 12B such that the collar extends above the plane bisecting the top of the occupant's shoulders and behind the head 112 of the occupant 100. In varying aspects, however, it is contemplated that the collar 11 can extend to a position at, above, or below the horizontal level center of gravity of the head and helmet 108 combined of the occupant. In this embodiment, the collar can be configured to allow for rotational movement of the helmet of the occupant. For example, it is contemplated that the collar can be curved to follow the shape of the helmet 108 of the occupant.

Figure 8:
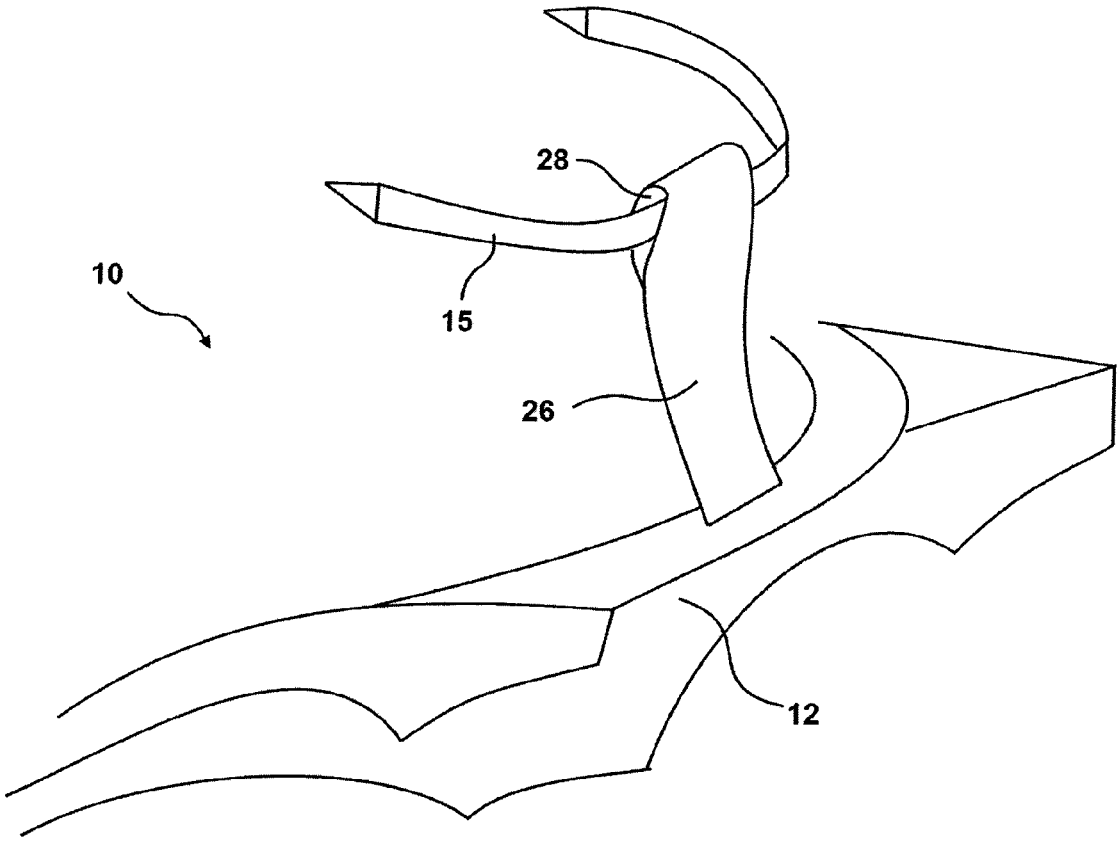
FIG. 8 is a perspective view of one embodiment of the head and neck support device having a flexible sleeve member.

In one aspect, the at least one sleeve member can be fixedly attached to a portion of the yoke. It is contemplated, and as shown in the figures, that the at least one sleeve member can be attached to the collar, if present. For clarity and conciseness, when used herein, the term "yoke" includes reference to a yoke with or without a collar. In one aspect, the at least one sleeve member can be formed from a rigid material, such as, for example and not meant to be limiting, a carbon fiber composite or a high impact resistant plastic material. Optionally, as shown in FIG. 8, the at least one sleeve member can be formed of a non-rigid material.

Figure 4:
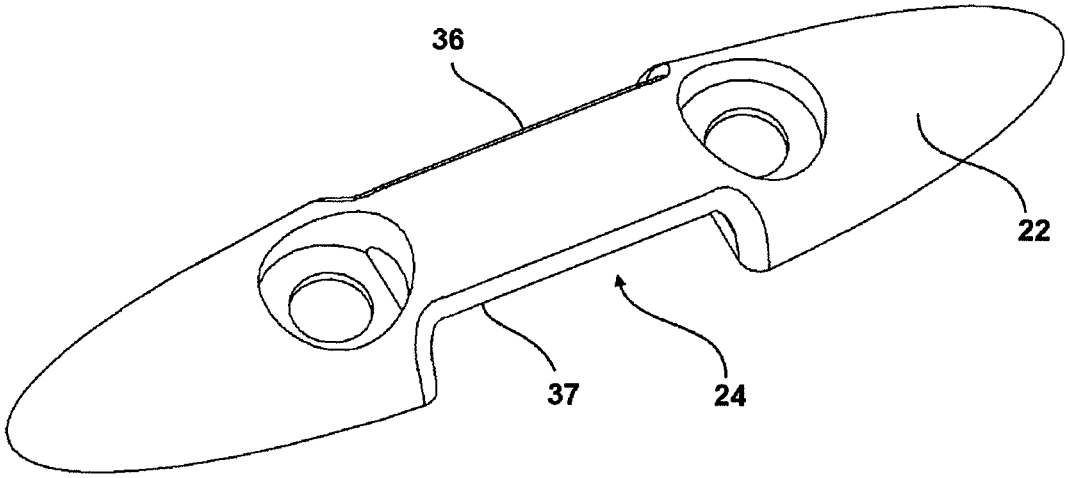
FIG. 4 is a perspective view of on embodiment of a sleeve member of the head and neck support device of FIG. 1.

As illustrated in FIG. 4, the sleeve member defines a cavity 24 that forms a channel that extends the entire width of the sleeve member, i.e., between a proximal end 37 and distal end 36 of the sleeve member. In one aspect, the sleeve member cavity is configured such that when the sleeve member 22 is mounted to a yoke, a portion of the tether is positioned in the cavity of the sleeve member in a plane that substantially bisects the sleeve member.

Figure 5:
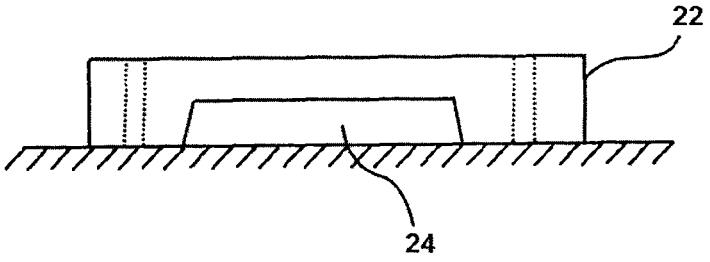
FIG. 5 is an end view of an exemplary embodiment of a sleeve member of the head and neck support device of FIG. 1.
Figure 6:
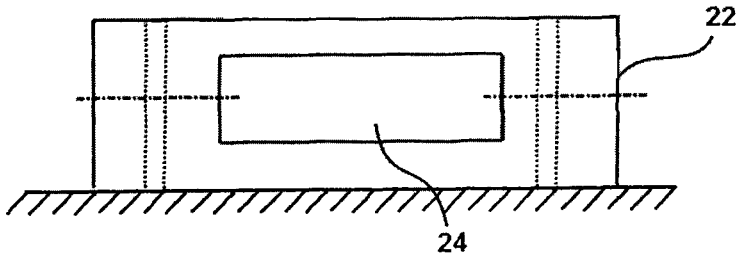
FIG. 6 is an end view of an exemplary embodiment of a sleeve member of the head and neck support device of FIG. 1.

In one exemplary aspect, the sleeve member 22 can be a single-sided sleeve member, as shown in FIG. 5. In this aspect, the single-sided sleeve member can be generally U-shaped with the channel being defined therebetween the legs of the sleeve member. In another aspect, the legs of the sleeve member can be mounted thereto a portion of the exterior surface of the yoke 12. Thus, the portion of the exterior surface of the yoke and the channel therein the sleeve member defines the cavity 24 of the sleeve member 22. Referring now to FIG. 6, an alternative exemplary aspect of the sleeve member is illustrated. In this aspect, the sleeve member is formed from the cooperative engagement of a pair of the single-side sleeve members. In this aspect, a first single-sided generally U-shaped sleeve member is connected to a portion of the exterior surface of the yoke 12 such that the legs of the first single-sided sleeve member extend outwardly away from the exterior surface of the yoke. A second single-sided sleeve member is mounted to the first single-sided sleeve member such that the legs of the respective first and second single-sided sleeve members are in contact. One will appreciate that the opposed channels of the first and second single-sided sleeve members defined the cavity 24 of the formed sleeve member 22.

Optionally, it is contemplated that the at least one sleeve member can be formed from a single piece of material. In one aspect, having the cavity defined by the sleeve member 22, and not by a portion of the exterior surface of the yoke, offsets or spaces at least a portion of the tether 15 from the exterior surface of the yoke 12, which can reduce friction between the tether and the yoke and can improve tether sliding performance.

In another embodiment and as mentioned above, a flexible sleeve member 26 can be formed from a flexible material, such as a strap, as illustrated in FIG. 8. In this aspect, an end loop 28 of the sleeve member defines the cavity of the at least one sleeve member and is configured to position at least a portion of the tether 15 in a plane that bisects the end loop.

It is contemplated that the at least one sleeve member 22 can be attached to the yoke 12 with conventional fastening means, such as, for example and without limitation, chemical adhesives, mechanical fasteners such as bolts, rivets, clamps, pressed stubs with nuts, and the like. In this aspect, complementary fastener holes can be defined in portions of the at least one sleeve member and the yoke.

The head and neck support device comprises a tether 15, as illustrated in FIG. 1. In one aspect, the tether has a first end 16, a second end 17, and a fixed length that extends a second distance between the respective first and second ends. In another aspect, the fixed length of the tether can be operatively selected. In this aspect, the second distance between the first and second ends of the tether 15 is greater than the first distance. In various exemplary aspects, the tether can be a rope, strap, wire, chain, cable, and the like, but is preferably constructed of a relatively inextensible, fibrous strap material. The length of the tether is selectably predetermined to allow some mobility of the head 112 while reducing fatigue and potentially injurious head motions, when assembled as described below. The length of the tether 15 preferably allows the occupant 100 to have the ability to rotate or otherwise move their head to increase their available sight area. The occupant is preferably able to move their head such as to have forward and lateral fields of view. In one exemplary aspect, the tether preferably allows the occupant to have a turning motion of the head around an axis that extends through the neck of the occupant 100 of about fifty degrees on either side of center. It is contemplated that the tether 15 can comprise a plurality of tethers. It is also contemplated that the tether 15 can be used in conjunction with other tethers for different purposes.

In operation, as will be described more fully below, a portion of the length of the tether 15 would slide generally in the cavity plane within the first distance of the at least one sleeve member 22. In one aspect, in order to prevent the tether from sliding too far in either direction, it is contemplated that the tether 15 can comprise a blocking device such as, for example and without limitation, a clip or the like, that can be positioned at a desired location along the tether so that only a desired portion of the tether can be slideably received therein the cavity 24 of the at least one sleeve member 22. In another aspect, in order to prevent the tether from sliding too far in either direction, it is contemplated that the tether 15 can change dimensions at a desired location along the tether so that portions of the tether are restricted from being slidably received therein the cavity.

FIG. 1 illustrates one embodiment having a plurality of sleeve members 22 on the yoke 12 of the head and neck support device 10. In this embodiment, the plurality of sleeve members comprises a first sleeve member 22' and an opposed, spaced second sleeve member 22" that are positioned on a portion of the rear surface 34 of the yoke such that the first distance extends from the distal end 36' of the first sleeve member 22' to the proximal end 37" of the second sleeve member 22". In a further aspect, the first distance can be defined generally in a cavity plane that bisects the cavity 24 in the at least one sleeve member. In the exemplary aspect having first and second sleeve members, the cavity plane substantially bisects the cavities of the respective first and second sleeve members.

As illustrated in FIG. 1, the at least one sleeve member 22 can be located on the rear portion 34 of the yoke 12, i.e., on the far side of the yoke from the head and helmet of the occupant 100. In this embodiment, the tether 15 wraps around the rear portion of the yoke and can make contact with portions of the yoke 12 if the outer edges of the at least one sleeve member 22 are not located at the respective outer edges of the yoke. It is also contemplated, however, that the at least one sleeve member can be located on the front portion 32 of the yoke, i.e., on the side of the yoke 12 nearest to the head and helmet of the occupant. In this embodiment, the tether position is restricted only by the sleeve member cavity and the portions of the tether 15 that extend from the respective proximal and distal ends of the at least one sleeve member 22 are not restricted.

Figure 7:
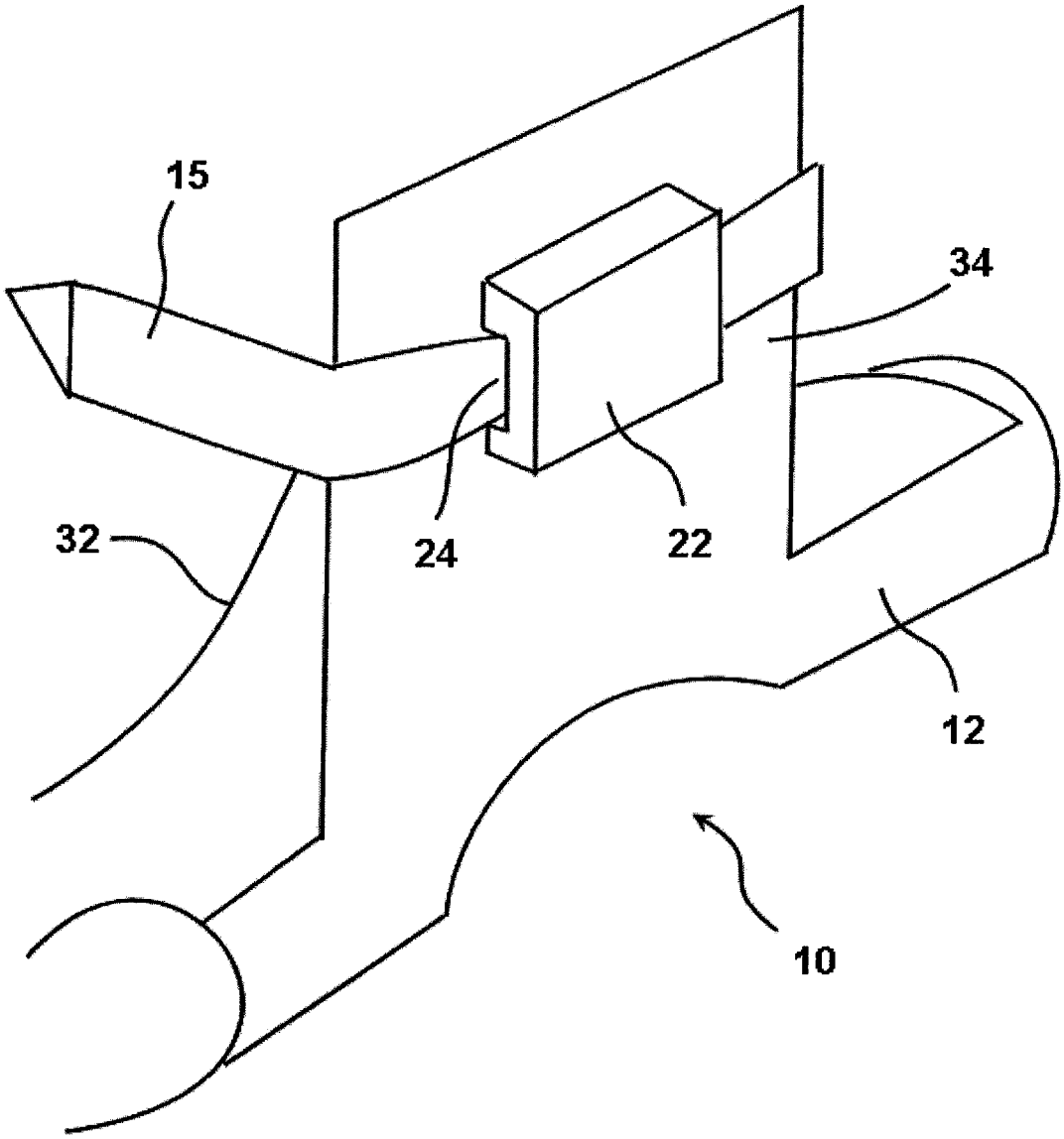
FIG. 7 is a perspective view of one embodiment of the head and neck support device having a single sleeve member.

In another embodiment, as shown in FIG. 7, a single sleeve member 22 can be attached to the yoke 12. In this embodiment, the cavity 24 defined therein the sleeve member defines a first distance that extends from the respective distal and proximal ends of the sleeve member. One would appreciate that a portion of the tether 15, when positioned within the cavity 24 of the sleeve member 22, is free to slide in the cavity plane within the first distance of the single sleeve member. In this embodiment, the single sleeve member 22 can be located on the rear portion 34 of the yoke 12, i.e., on the far side of the yoke from the head and helmet of the occupant. It is also contemplated, however, that the single sleeve member can be positioned on the front portion 32 of the yoke, i.e., on the side of the yoke nearest to the head and helmet of the occupant.

Similarly, in a further embodiment, illustrated in FIG. 8, a single flexible sleeve member 26 can be attached to the yoke 12. The tether 15, when positioned within the end loop 28 of the flexible sleeve member, is free to slide through the end loop of the flexible sleeve member. In another aspect, a plurality of flexible sleeve members may be placed on the yoke of the head and neck support device 10. In an exemplary example, in which the plurality of flexible sleeve members comprises a first flexible sleeve member and an opposed second flexible sleeve member, the respective first and second flexible sleeve members are spaced apart from each other such that the first distance extends from a distal end of the first flexible sleeve member to the proximal end of the second flexible. Thus, the exemplary first and second flexible sleeve members 26 can be positioned on the yoke 12 in order to define a first distance between the respective first and second flexible sleeve members. The tether, when positioned within the end loops of the respective first and second flexible sleeve members, is free to slide in the cavity plane that bisects the respective first and second flexible sleeve member cavities.

Figure 9:
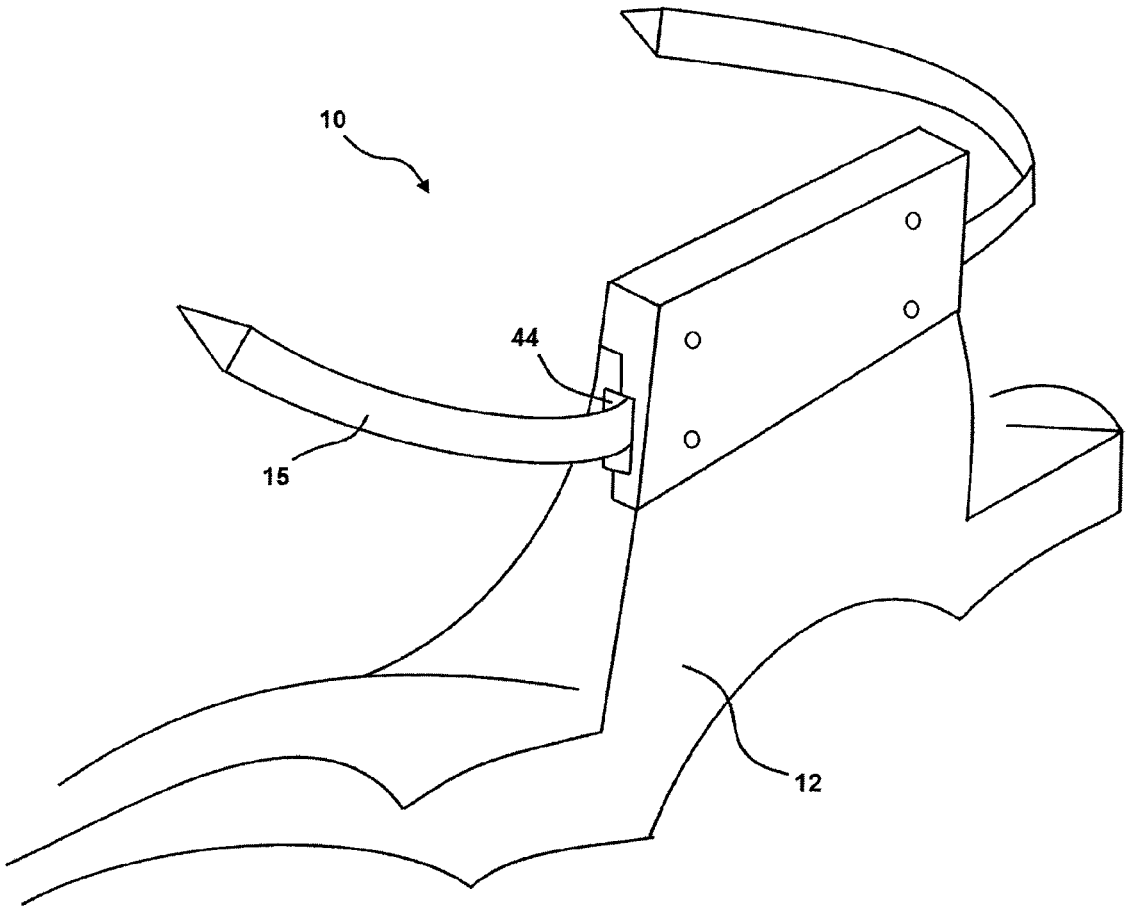
FIG. 9 is a perspective view of one embodiment of the head and neck support device.

In another embodiment, as illustrated in FIG. 9, a channel 44 for positioning the tether 15 can be defined within a portion of the yoke 12. At least one sleeve member can be mounted over the channel such that the sleeve member cavity is defined therebetween the sleeve member and the channel 44 of the yoke. In the illustrated example, the channel is formed in a top portion of the collar 11 and the single sleeve member is mounted to the top portion of the collar to define a single sleeve member cavity. In one aspect, the channel is positioned substantially parallel to the top edge of the collar.

With reference to FIG. 1, a head and neck support device can be assembled to comprise any or all of the components as described above. In one aspect, the at least one sleeve member 22 can be attached to the yoke 12, or integrally formed therein the yoke. As desired, sleeve members can be added to the yoke or removed from the yoke, and/or the length of sleeve members altered, to vary the first distance of the device. The first distance may be varied in order to change the angle between a cavity plane that bisects the outermost sleeve member(s) and the helmet tether connection points, which are described more fully below.

Figure 10A:
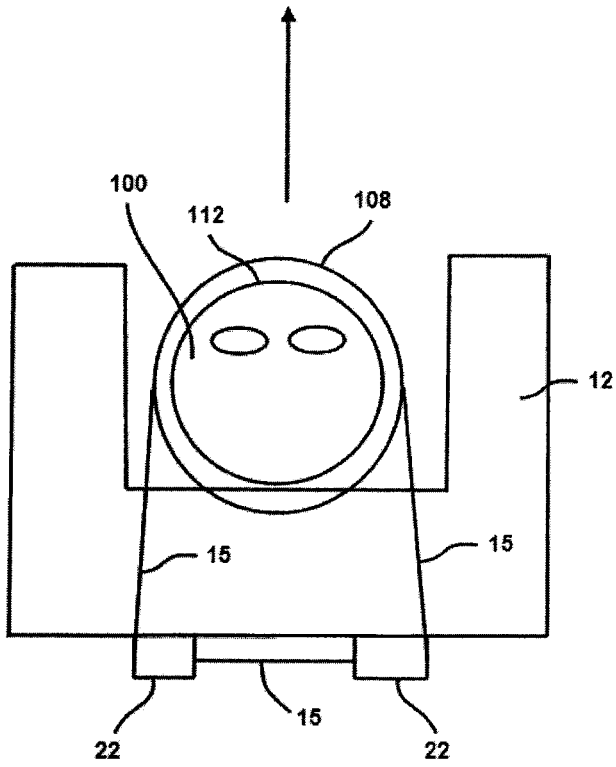
FIG. 10A is a top schematic view of the head and neck support device of FIG. 1 on an occupant looking forward.

The tether 15 can be inserted through the sleeve members. The first end of the tether can be attached to a side of the helmet 108 of the occupant 100, and the second end of the tether can be attached to the opposite side of the helmet, as illustrated in FIG. 10A. In one embodiment, as known in the art, a helmet anchor can be mounted to the helmet. The ends of the tether can be attached to the anchor by, for example and without limitation, a shackle, a post and post catch system or the like. In another embodiment, the ends of the tether can be formed with loops, so that the ends of the tether can be attached to the helmet by threading helmet chin straps on either side of the helmet through the loops on the tether ends. In still another embodiment, in one aspect, the helmet can have slots defined therein either side configured for receiving the ends 16, 17 of the tether. In another aspect, the ends of the tether 15 can be configured to be insertable into, yet difficult to extract from, the slots of the helmet 108 so that the tether resists extraction from the helmet 108. In yet another embodiment, in one aspect, the helmet can have slots defined therein either side. In another aspect, the ends 16, 17 of the tether 15 can be inserted through the slots of the helmet and then securedly attached to each other to form a continuous tether that resists extraction from the helmet.

As illustrated in FIG. 3, the head and neck support device 10 of the present invention is mounted on the occupant 100 of a vehicle such that the pair of spaced opposing legs 12A and 12B of the yoke 12 extend down along the front of the torso 104 of the occupant 100 and the connecting portion 12C of the yoke extends behind the neck 106 and shoulders 102 of the occupant. The device is mounted such that the neck of the occupant is positioned adjacent the notch 12D of the connecting portion of the yoke. In a preferred embodiment, the legs of the yoke 12 adjacent the front of the torso of the occupant are positioned such that an angle relative to the horizontal axis of the vehicle is between about 30° to 50° when the device 10 is securely held in place on the occupant 100 and the occupant is sitting in the vehicle.

The device is securely held in place by the shoulder belts 110A of the shoulder harness 110 when the occupant is securely belted into the vehicle. The device is only secured to the occupant 100 of the vehicle by the shoulder belts. This allows the occupant to exit the vehicle without having to remove the device 10. As illustrated in FIG. 3, the shoulder belts of the shoulder harness extend along the load bearing surfaces 14 of the yoke such that the yoke is between the shoulder belts and the occupant and the load bearing surfaces are above and behind the shoulders 102 of the occupant and between the shoulders of the occupant and the seat back (not shown). The load bearing surfaces of the yoke 12 at the connecting portion 12C are positioned such that the shoulder belts 110A of the shoulder harness adjacent the connecting portion are substantially parallel with the horizontal level of the top of the shoulders of the occupant 100. The shoulder belts of the shoulder harness 110 hold the yoke securely in contact with the front of the torso 104 and the shoulders of the occupant during both normal vehicle operation and during a crash. The yoke is connected by the tether 15 to the helmet 108 on the head 112 of the occupant. The connection of the tether to the helmet tends to pull the entire device 10 forward and the connecting portion 12C of the device upward. During a crash, the tether carries tension forces from the helmet to the head and neck support device.

Figure 10B:
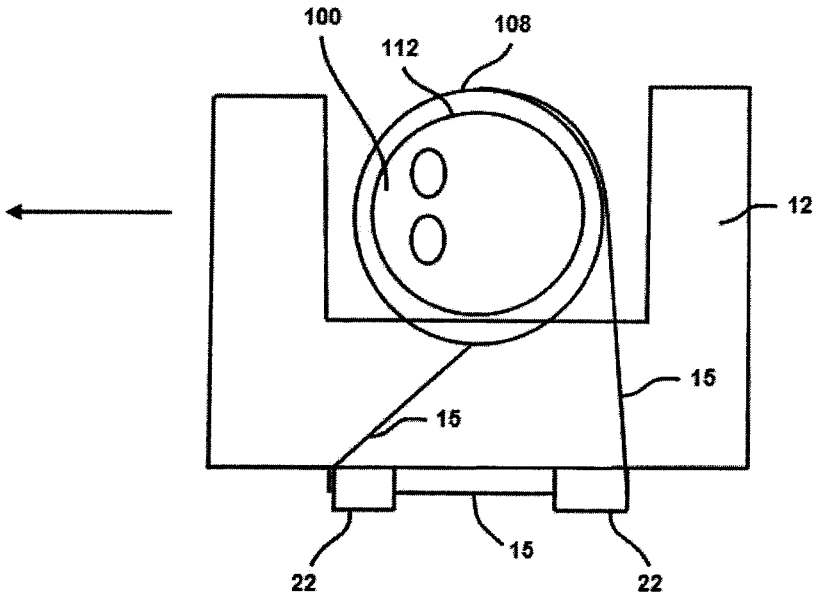
FIG. 10B is a top schematic view of the head and neck support device of FIG. 1 on an occupant looking to the left.

With the device fully assembled and mounted on the user as described above, the sliding tether arrangement allows the occupant side-to-side rotary head mobility around an axis that extends generally co-axial through the vertebra of the neck of the user. As illustrated in FIG. 10B, when the occupant 100 turns their head 112 to the left, as viewed from above, the distance from the end of the tether on the left side of the occupant's head to the leftmost sleeve member 22 decreases, so that less tether length is required on the left side of the occupant's head. Simultaneously, the end of the tether 15 on the right side of their head exerts a force on the tether because that end of the tether is being moved to a distance farther away from the rightmost sleeve member. This force causes the tether 15 to slide through the at least one sleeve member 22 towards the right, so that there is a greater length of tether between the right side of the occupant's head and the rightmost sleeve member than between the left side of the occupant's head and the leftmost sleeve member. The sliding tether allows the occupant 100 to continue turning their head 112 to the left until a blocking device attached to the tether or a change in the tether dimensions restricts the tether 15 from sliding further into the sleeve member cavity. If there is no tether blocking device or tether dimensional change, the occupant may continue turning their head further to the left until the distance between the tether connection point on the left side of the helmet 108 and the outer edge of the leftmost sleeve member is a minimum.

Similarly, when the occupant turns their head 112 to the right, as viewed from above, the tether slides through the at least one sleeve member towards the left. The sliding tether 15 allows the occupant to continue turning their head to the right until a blocking device attached to the tether or a change in the tether dimensions restricts the tether from sliding further into the sleeve member cavity. If there is no tether blocking devices or tether dimensional changes, the occupant 100 may continue turning their head further to the right until the distance between the tether connection point on the helmet on the right side of the helmet and the outer edge of the rightmost sleeve member is a minimum.

In rearward vehicle acceleration or frontal crash (such as in applying the brakes or striking something with the front of the vehicle) with forward head motion relative to the torso, the yoke 12 will tend to move forward relative to the vehicle and rotate with the top of the yoke moving forward relative to the bottom due to the head/helmet restraining forces. The tendency for the yoke to move forward will be restrained by the shoulder belts 110A in much the same way as normally occurs without the device 10 present. The tendency for the top of the device to rotate forward such that the rear of the device moves up will be restrained by the shoulder belts acting downward and rearward on the load bearing surfaces 14 of the yoke adjacent the top of and to the rear of the shoulders 102. This constraint of rotation will also reduce the tendency of the front, lower part of the yoke to load the rib cage. The body of the occupant 100 also tends to move forward relative to the vehicle.

The torso 104 of the occupant is restrained by rearward force from the shoulder harness 110 and the yoke 12. The shoulder harness includes shoulder belts 110A over the occupant's shoulders, around their lap and between their legs. The head and neck support device is held in place on the torso of the occupant by the shoulder harness. The head 112 tends to continue moving forward but is restrained to move with the torso as a result of the forces applied through the tether 15. Thus, as the vehicle is accelerated rearward, the head, torso and yoke move forward relative to the vehicle, the torso and yoke are restrained by the shoulder harnesses, and the head and helmet 108 are restrained to move with the torso 104 by the device. The forces to restrain the head and helmet will be predominately carried through the device 10 to the shoulder belts.

The tether force restraining the head reduces the loading of the neck 106. Thus, the tether force reduces the fatiguing demands on the neck and the potential for injury from the loads that would be present without the device. The tether also reduces extreme head and neck motion relative to the torso of occupant 100. The loads from the tether 15 are transmitted through the yoke 12 to the torso and shoulder belts of the shoulder harness 110. The friction material 18 attached to the load bearing surfaces 14 increases the frictional forces acting rearward on the load bearing surfaces from the shoulder belts 110A. In this way, the load bearing surfaces effectively restrain the head and neck support device to carry the tether force which restrains the head 112 of the occupant to move with the torso.

In a frontal crash, the acceleration forces and the restraint forces on the occupant 100 are primarily horizontal. The tether restrains the motions of the occupant's head such that the occupant's head moves with the occupant's torso 104 which reduces the undesirable forces in the occupant's neck that may cause injuries to the head 112 and neck 106. The tether 15 also reduces head motions and accelerations that are due to head rotations in side view. The shoulder belts apply downward and rearward loads on the load bearing surfaces, adjacent to and behind the shoulders 102 of the occupant to counteract the tether forces acting between the yoke 12 and the helmet 108 of the occupant. The loads from the shoulder belts 110A on the load bearing surfaces act through the device 10 and the tether to resist the forward motions of the head of the occupant 100 relative to the torso of the occupant. Because the head and neck support device is between the occupant's torso 104 and the shoulder harness 110, the forces that restrain the helmeted head are transmitted through the head and neck support device to the occupant's torso and the shoulder harness.

In a rear crash with forward acceleration, the occupant tends to move rearward and upward because of the angle of the seat back. The structure that supports the head 112 moves rearward with the front of the torso 104. The friction with the shoulder belts of the shoulder harness slows the occupant as the torso of the occupant moves upward relative to the shoulder harness. The device 10 is between the occupant's shoulders and the shoulder belts to increase the forces from the shoulder belts 110A and to create more downward force as the occupant slides up the seat back. Thus, the head and neck support device improves the restraint of the occupant's upper torso in a rear crash.

In sideways acceleration (such as in striking an object with the side of the vehicle), assume, for the sake of illustration, that the vehicle is accelerated to the left as would occur in turning toward the left or striking an object with right side of the vehicle and that forces and motions are expressed relative to the vehicle. The torso is restrained by the seat and harness 110. The helmet 108 and head are restrained to accelerate to the left with the torso by tension in the tether 15 on the left side. The tether is configured so that with sideward motion the helmeted head 112 also moves rearward into the yoke 12. In sideways acceleration, the loads on the yoke from the helmeted head tend to rotate the top of the yoke away from the direction of the acceleration (top toward the right in the current example). The yoke tends to move downward onto the right shoulder 102 and upward off of the left shoulder. This tendency to rotate is resisted by the forces between the yoke 12 and the right shoulder and between the yoke and the shoulder harness 110 on the left side. The head, helmet, and device 10 also tend to move to the right. This motion is resisted by the shoulder harness on the right and, to some extent, by the shoulder belt 110A on the load bearing surfaces 14 on the left side of the yoke and the contact between the yoke and the upper shoulders 102 and neck 106.

Thus, the accelerations of the head 112, helmet 108, neck, and torso, with components in forward, rearward or sideward directions, are restrained as combinations of the mechanical responses described above.

The load bearing surfaces extend rearward from the top of the occupant's shoulders so that, when racing, these load bearing surfaces 14 lie below the shoulder belts of the shoulder harness. Since the shoulder belts can be secured to the vehicle below the edge of the load bearing surfaces at the connecting portion 12C of the device 10, the load bearing surfaces of the head and neck support device will be loaded by the shoulder belts while the occupant 100 is racing and this loading of the head and neck support device is transmitted to the occupant's shoulders 102 to help hold the occupant down in the seat.

The load bearing surfaces provide a load path for the forces from the tether 15 through the head and neck support device to the shoulder belts 110A. The head and neck support device of the present invention is small and easy to handle which enables occupants to wear the device with very little interference between the head and neck support device and the helmet 108 during normal racing.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention.

What is claimed is:

1. A head and neck support device for an occupant of a vehicle with a shoulder harness over the shoulders of the occupant and a helmet on a head of the occupant, which comprises:

a yoke having a front portion a rear portion, the yoke configured for being disposed behind the neck and over the shoulders and front portion of the torso of the occupant;

a tether having an elongate length, a first end and a second end;

means for attaching the first end of the tether to a first side of the helmet, and a means for attaching the second end of the tether to a second, opposite side of the helmet;

a plurality of sleeve members fixedly attached to a portion of the yoke, wherein each sleeve member defines a cavity therethrough;

wherein the tether is configured to slidably move within the cavity of each sleeve member of the plurality of sleeve members upon rotation of the head of the occupant relative to the yoke;

the tether having a first end portion having a length between one sleeve member of the plurality of sleeve members and the first end of the tether, and a second end portion having a length between another sleeve member of the plurality of sleeve members and the second end of the tether, wherein the length of the first end portion increases and the length of the second end portion decreases upon rotation of the head of the occupant relative to the yoke; and a blocking device positioned along the tether so that only a desired portion of the tether can be slidably received therein the cavity of at least one of the plurality of sleeve members.

2. The head and neck support device of claim 1, wherein at least one sleeve member of the plurality of sleeve members defines a first distance.

3. The head and neck support device of claim 2, wherein the tether defines a second distance.

4. The head and neck support device of claim 3, wherein the second distance is greater than the first distance.

5. The head and neck support device of claim 4, wherein the tether second distance slidably moves within the sleeve member.

6. The head and neck support device of claim 1, wherein at least one sleeve member of the plurality of sleeve members is fixedly attached to the rear portion of the yoke.

7. The head and neck support device of claim 1, wherein at least one sleeve member of the plurality of sleeve members is fixedly attached to the front portion of the yoke.

8. The head and neck support device of claim 1, wherein at least one sleeve member of the plurality of sleeve members is a single-sided sleeve member.

9. The head and neck support device of claim 1, wherein at least one sleeve member of the plurality of sleeve members is a double-sided sleeve member.

10. The head and neck support device of claim 1, wherein at least one sleeve member of the plurality of sleeve members is flexible.

11. The head and neck support device of claim 1, wherein at least one sleeve member of the plurality of sleeve members is rigid.

12. The head and neck support device of claim 1, wherein at least one sleeve member of the plurality of sleeve members is formed therein the yoke.

13. The head and neck support device of claim 1, wherein each sleeve member is positioned adjacent an upright side edge of the yoke.

14. The head and neck support device of claim 1, wherein the means for attaching the first end of the tether to the first side of the helmet comprises a tether anchor mounted to the helmet, and the means for attaching the second end of the tether to the second side of the helmet comprises a tether anchor mounted to the helmet.

15. The head and neck support device of claim 13, wherein the means for attaching the first end of the tether to the first side of the helmet comprises attaching the first end of the tether to a helmet chin strap, and the means for attaching the second end of the tether to the second side of the helmet comprises attaching the second end of the tether to a helmet chin strap.

16. The head and neck support device of claim 13, wherein the means for attaching the first end of the tether to the first side of the helmet comprises attaching the first end of the tether through a first slot defined therein the first side of the helmet, wherein the first end of the tether is configured to resist extraction, and the means for attaching the second end of the tether to the second side of the helmet comprises attaching the second end of the tether through a second slot defined therein the second side of the helmet, wherein the second end of the tether is configured to resists extraction.

17. The head and neck support device of claim 13, wherein the means for attaching the first end of the tether to the first side of the helmet comprises attaching the first end of the tether through a first slot defined therein the first side of the helmet and the second end of the tether through a second slot defined therein the second side of the helmet; and wherein the first and second ends of the tether are continuous such that they resist extraction.

18. The head and neck support device of claim 1, wherein the yoke further comprises a collar.

19. The head and neck support device of claim 18 wherein at least one sleeve member of the plurality of sleeve members is connected to the collar of the yoke.

20. The head and neck support device of claim 1, wherein the tether comprises a rope.

21. The head and neck support device of claim 1, wherein the tether comprises a wire.

22. The head and neck support device of claim 1, wherein the tether comprises a chain.

23. The head and neck support device of claim 1, wherein the tether comprises a strap.

24. A method for providing protection for an occupant of a vehicle, the vehicle having a shoulder harness with shoulder belts, which comprises the steps of:

(a) providing a helmet for a head of the occupant:

(b) providing a head and neck support device comprising:

a yoke having a front portion a rear portion, the yoke configured for being disposed behind the neck and over the shoulders and front portion of the torso of the occupant;

a tether having an elongate length, a first end and a second end;

(c) attaching the first end of the tether to a first side of the helmet (d) attaching the second end of the tether to a second, opposite side of the helmet (e) fixedly attaching a plurality of sleeve members to a portion of the yoke, wherein each sleeve member defines a cavity therethrough;

wherein the tether is configured to slidably move within the cavity of each sleeve member of the plurality of sleeve members upon rotation of the head of the occupant relative to the yoke;

the tether having a first end portion having a length between one sleeve member of the plurality of sleeve members and the first end of the tether, and a second end portion having a length between another sleeve member of the plurality of sleeve members and the second end of the tether, wherein the length of the first end portion increases and the length of the second end portion decreases upon rotation of the head of the occupant relative to the yoke; and a blocking device positioned along the tether so that only a desired portion of the tether can be slidably received therein the cavity of at least one of the plurality of sleeve members.

25. The head and neck support device of claim 1, wherein the tether is configured to slidably move within the cavity of each sleeve member of the plurality of sleeve members in a common plane that bisects each cavity.

26. A head and neck support device for an occupant of a vehicle with a shoulder harness over the shoulders of the occupant and a helmet on a head of the occupant, which comprises:

a yoke having a front portion and a rear portion, the yoke configured for being disposed behind the neck and over the shoulders and front portion of the torso of the occupant;

a tether having an elongate length, a first end and a second end;

means for attaching the first end of the tether to a first side of the helmet, and a means for attaching the second end of the tether to a second, opposite side of the helmet;

a plurality of sleeve members fixedly attached to a portion of the yoke, wherein each sleeve member defines a cavity therethrough;

wherein the tether is configured to operationally slide within the cavity of each sleeve member of the plurality of sleeve members;

the tether having a first end portion having a length between one sleeve member of the plurality of sleeve members and the first end of the tether, and a second end portion having a length between another sleeve member of the plurality of sleeve members and the second end of the tether, wherein the length of the first end portion increases and the length of the second end portion decreases upon rotation of the head of the occupant relative to the yoke; and a blocking device positioned along the tether so that only a desired portion of the tether can be slidably received therein the cavity of at least one of the plurality of sleeve members.

* * * * *

UNITED STATES PATENT AND TRADEMARK OFFICE

CERTIFICATE OF CORRECTION

PATENT NO. : 8,850,625 B2
APPLICATION NO. : 12/329388
DATED : October 7, 2014
INVENTOR(S) : Mark A. Stiles It is certified that error appears in the above-identified patent and that said Letters Patent is hereby corrected as shown below:

In the Claims

Column 13
Claim 24, line 15 should read: (a) providing a helmet for a head of the occupant“:”--;--
Claim 24, line 24 should read: helmet--;--
Claim 24, line 26 should read: opposite side of the helmet--;--

Signed and Sealed this
Tenth Day of February, 2015

Michelle K. Lee

Michelle K. Lee
*Deputy Director of the United States Patent and Trademark Office*